US011065754B2

(12) United States Patent
Watanabe

(10) Patent No.: US 11,065,754 B2
(45) Date of Patent: Jul. 20, 2021

(54) ELECTRIC POWER TOOL CONFIGURED TO OPERATE IN A NORMAL MODE WITH A SPECIFIC STAGE, AND IN A MEASUREMENT MODE WITH A COMMON STAGE

(71) Applicant: MAKITA CORPORATION, Anjo (JP)

(72) Inventor: Masahiro Watanabe, Anjo (JP)

(73) Assignee: MAKITA CORPORATION, Anjo (JP)

( * ) Notice: Subject to any disclaimer, the term of this patent is extended or adjusted under 35 U.S.C. 154(b) by 410 days.

(21) Appl. No.: 15/710,294

(22) Filed: Sep. 20, 2017

(65) Prior Publication Data

US 2018/0085908 A1 Mar. 29, 2018

(30) Foreign Application Priority Data

Sep. 26, 2016 (JP) ..... JP2016-186902

(51) Int. Cl.
*B25F 5/00* (2006.01)
*B25B 23/147* (2006.01)
(Continued)

(52) U.S. Cl.
CPC ..... *B25F 5/001* (2013.01); *B25B 21/008* (2013.01); *B25B 23/141* (2013.01);
(Continued)

(58) Field of Classification Search
CPC ..... B25F 5/001; B25F 5/00; B25B 23/147; B25B 21/008; B25B 23/141
(Continued)

(56) References Cited

U.S. PATENT DOCUMENTS 5,154,242 A 10/1992 Soshin et al.
5,440,215 A * 8/1995 Gilmore ..... B23P 19/066 173/178
(Continued)

FOREIGN PATENT DOCUMENTS

EP 2 572 834 A1 3/2013
JP H0647635 A 2/1994
(Continued)

OTHER PUBLICATIONS

Feb. 19, 2018 Extended Search Report issued in European Patent Application No. 17192395.6.
(Continued)

*Primary Examiner* — Anna K Kinsaul
*Assistant Examiner* — Chinyere J Rushing-Tucker
(74) *Attorney, Agent, or Firm* — Oliff PLC

(57) ABSTRACT

An electric power tool includes a motor and a controller. The controller is configured to control the motor. Specifically, the controller is configured to operate in at least two modes: a first mode and a second mode. The first mode includes a plurality of stages having different control conditions related to the motor. The second mode includes at least a common stage having control conditions same as those for a specific stage among the plurality of stages of the first mode. The common stage of the second mode starts more quickly than the specific stage of the first mode.

19 Claims, 8 Drawing Sheets

(51) Int. Cl.

| | |
|---|---|
| ***B25B 21/00*** | (2006.01) |
| ***B25B 23/14*** | (2006.01) |
| *B25B 23/142* | (2006.01) |
| *G08C 17/02* | (2006.01) |

(52) U.S. Cl.
CPC ..... *B25B 23/147* (2013.01); *B25F 5/00* (2013.01); *B25B 23/1427* (2013.01); *G08C 17/02* (2013.01)

(58) Field of Classification Search
USPC ..... 173/2
See application file for complete search history.

(56) References Cited

U.S. PATENT DOCUMENTS

2006/0281596 A1* 12/2006 Milbourne ..... B23B 45/008 475/183
2010/0096155 A1* 4/2010 Iwata ..... B25B 21/02 173/176
2010/0237124 A1* 9/2010 Shima ..... B25C 1/06 227/8
2013/0062086 A1* 3/2013 Ito ..... B25B 23/1405 173/1
2013/0076271 A1* 3/2013 Suda ..... B25F 5/00 318/3
2013/0186666 A1* 7/2013 Yoshino ..... B25B 23/1475 173/176
2013/0269961 A1* 10/2013 Lim ..... B25F 5/001 173/1
2013/0327552 A1* 12/2013 Lovelass ..... B25F 5/00 173/1
2015/0209951 A1* 7/2015 Lutz ..... B23Q 17/00 173/20
2016/0107297 A1* 4/2016 Ishikawa ..... B25B 23/18 173/179
2016/0301340 A1* 10/2016 Najjar ..... H02P 6/28
2016/0342151 A1* 11/2016 Dey, IV ..... G05B 19/4155
2017/0162035 A1 6/2017 Kusakawa
2018/0222022 A1* 8/2018 Kumagai ..... B25F 5/021

FOREIGN PATENT DOCUMENTS

JP H07227729 A 8/1995
JP H081457 A 1/1996
JP 2001-129767 A 5/2001
JP 2011-251355 A 12/2011
JP 2015-223638 A 12/2015
WO 2011/152136 A1 12/2011

OTHER PUBLICATIONS

Mar. 10, 2020 Office Action issued in Japanese Patent Application No. 2016-186902.

* cited by examiner

ELECTRIC POWER TOOL CONFIGURED TO OPERATE IN A NORMAL MODE WITH A SPECIFIC STAGE, AND IN A MEASUREMENT MODE WITH A COMMON STAGE

CROSS-REFERENCE TO RELATED APPLICATIONS

This application claims the benefit of Japanese Patent Application No. 2016-186902 filed on Sep. 26, 2016 with the Japan Patent Office, the entire disclosure of which is incorporated herein by reference.

BACKGROUND

The present disclosure relates to an electric power tool.

A powered screwdriver, which is a kind of electric power tool, is disclosed in Japanese Unexamined Patent Application Publication No. 2015-223638. This powered screwdriver is configured such that control conditions for a motor are changed in stages during a period between the start and the end of screw-tightening. The control conditions include, for example, a condition related to the rotation speed of the motor. Specifically, a control processing for the motor includes a plurality of stages having different control conditions, and the plurality of stages are carried out one by one to perform the screw-tightening.

SUMMARY

However, in conventional electric power tools like the above-described screwdriver, users cannot advance the timing of starting a specific stage among the plurality of stages as they desire.

Accordingly, in one aspect of the present disclosure, it is desirable to be able to provide, in the electric power tool, a technique of advancing the timing of starting a specific stage among a plurality of stages in the control processing for the motor.

An electric power tool in one aspect of the present disclosure includes a motor and a controller. The controller is configured to operate in at least two modes: a first mode and a second mode. The first mode includes a plurality of stages having different control conditions related to the motor. The second mode includes at least a common stage having control conditions same as those for a specific stage among the plurality of stages of the first mode. The common stage of the second mode starts more quickly than the specific stage of the first mode.

In such an electric power tool, when the controller is switched from the first mode to the second mode, a timing of starting the specific stage is advanced.

The first mode may be a normal mode. The second mode may be a measurement mode. The common stage may be a final stage of the first mode. The plurality of stages of the first mode may include a plurality of stages having different control conditions related to a rotation speed of the motor.

The first mode may be a mode employed for a screw-tightening operation. The second mode may be a mode employed for measurement of a tightening torque. The motor may be controlled to a rotation speed suitable for a final process of the screw-tightening operation in the specific stage and the common stage.

In this case, the time required for measurement of the tightening torque can be shortened by measuring the tightening torque when the controller operates in the second mode.

The second mode may be a mode including the common stage corresponding to the specific stage but not including at least one of the stages prior to the specific stage, among the plurality of stages of the first mode.

The second mode may be a mode including the common stage alone corresponding to the specific stage among the plurality of stages of the first mode.

The controller may be configured to switch to the second mode at least partially based on a determination that a specific operation has been performed by a user. The specific operation may include a plurality of operations. The controller may be configured to switch to the second mode at least partially based on a determination that the plurality of operations have been performed in a specified order. In such a configuration, the user can switch the controller to the second mode at any given timing.

The controller may be configured to switch to the second mode at least partially based on a determination that a trigger switch is on while a battery pack is being attached. Since such an operation of the trigger switch is usually not performed, it is possible to inhibit the user from erroneously switching the controller to the second mode.

The controller may be configured to switch to the second mode further based on a determination that the trigger switch has been switched off after the battery pack is attached. The controller may be configured to switch to the second mode further based on a determination that a lever to switch a rotation direction of the motor has been operated after the trigger switch is switched off. In this case, the effect of inhibiting the user from erroneously switching the controller to the second mode can be enhanced.

The controller may be configured to switch to the second mode based on a specified schedule.

The controller may be configured to switch to the second mode upon determining that a specified date and time has been reached based on a time information. In such a configuration, the operation mode of the controller can be automatically set to the second mode.

BRIEF DESCRIPTION OF THE DRAWINGS

Example embodiments of the present disclosure will be described below by way of example with reference to the accompanying drawings, in which.

DETAILED DESCRIPTION OF THE PREFERRED EMBODIMENTS

1. First Embodiment

1-1. Overall Structure of Electric Power Tool

Figure 1:
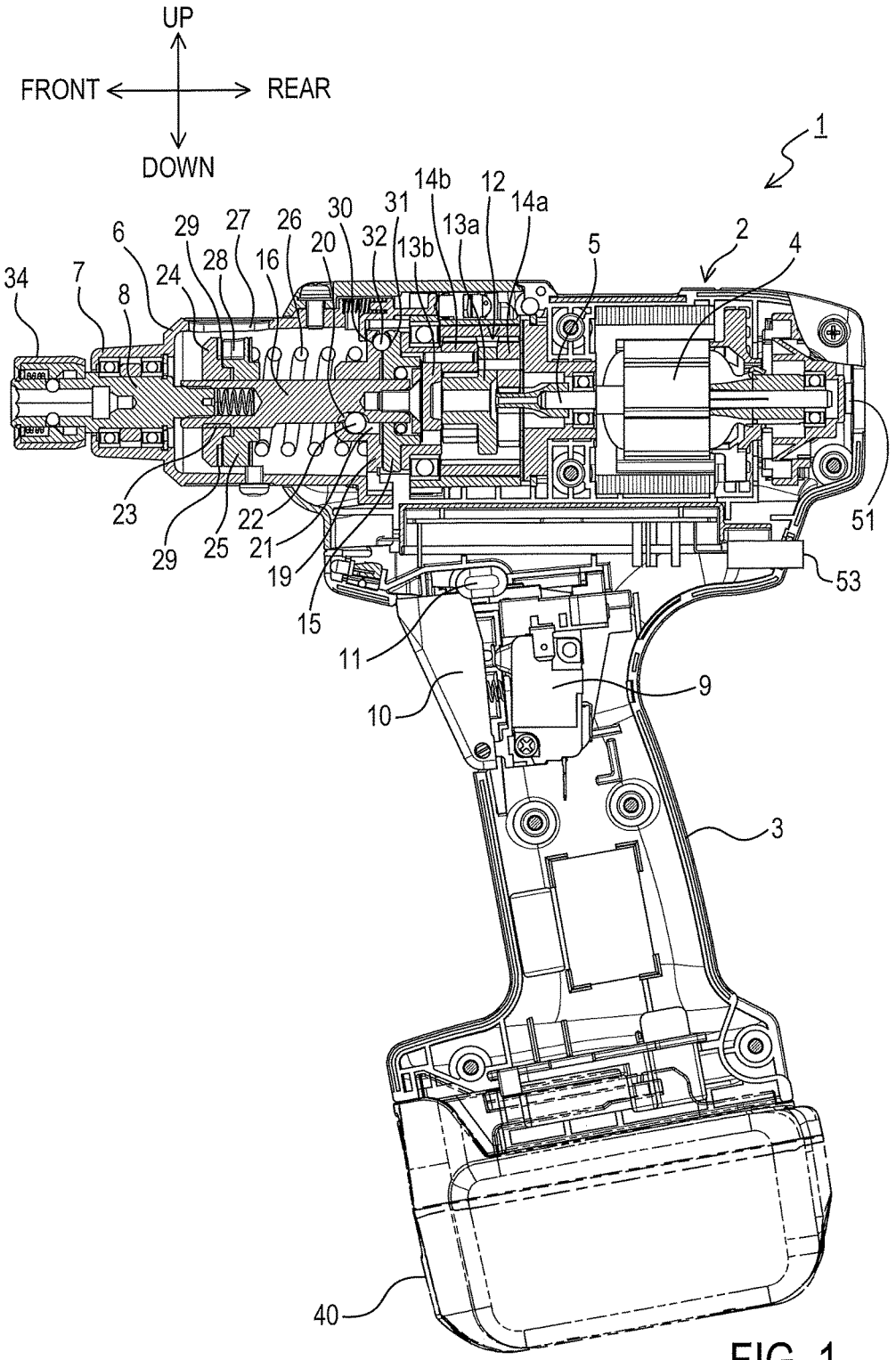
FIG. 1 is a longitudinal sectional view of an electric power tool according to one example embodiment.

An electric power tool 1 of the present embodiment shown in FIG. 1 is configured as a rechargeable screwdriver.

This rechargeable screwdriver is used, for example, for screw-tightening operation for industrial products, such as automobiles, in assembly plants for the industrial products.

The electric power tool 1 includes a main body housing 2 and a battery pack 40. Extendingly provided beneath the main body housing 2 is a handle 3. The handle 3 is a portion to be grabbed by an operator at use of the electric power tool 1. The battery pack 40 functions as a power source. The battery pack 40 is detachably attached to a bottom part of the handle 3.

The battery pack 40 houses a battery. The battery is a rechargeable battery, which can be repeatedly charged, and is, for example, a lithium-ion battery. The battery pack 40 is attached to a lower end of the handle 3 by being slid from a front side toward a rear side with respect to the lower end of the handle 3. The battery pack 40 attached to the handle 3 is detached from the lower end of the handle 3 by being slid from the rear side toward the front side with respect to the lower end of the handle 3.

The main body housing 2 houses in a rear part thereof a motor 4 as a source of power. The motor 4 is configured as, for example, a three-phase brushless motor. Mounted to a front part of the main body housing 2 is a leading-end housing 6. The leading-end housing 6 includes a tubular portion 7 positioned at a front end thereof. An output shaft 8 is journally supported at the tubular portion 7.

Provided at an upper part of the handle 3 are a switch 9 and a trigger 10. The switch 9 is used to start the motor 4. The trigger 10 is configured as an operation portion to be subjected to a pulling operation by the operator. The switch 9 is turned ON when the trigger 10 is subjected to the pulling operation. The switch 9 is hereinafter referred to as a trigger switch 9. The pulling operation is merely referred to as operation.

In the handle 3, provided upper than the trigger switch 9 and the trigger 10 is a forward/reverse lever 11. The forward/reverse lever 11 is used to set the rotation direction of the motor 4 to either a forward rotation direction or a reverse rotation direction. The forward rotation direction of the motor 4 is a rotation direction for tightening a screw, that is, a clockwise direction as viewed from a rear end side of the electric power tool 1 toward a front side. The reverse rotation direction of the motor 4 is a rotation direction for loosening the screw.

The forward/reverse lever 11 is a lever that can be slidingly operated in a left-right direction. The left-right direction mentioned here corresponds to a left-right direction as viewed from the rear end side of the electric power tool 1 toward the front side. When the forward/reverse lever 11 is positioned on the left side, the rotation direction of the motor 4 is set to the forward rotation direction. When the forward/reverse lever 11 is positioned on the right side, the rotation direction of the motor 4 is set to the reverse rotation direction. Provided to the handle 3 as a switch to detect the position of the forward/reverse lever 11 is a forward/reverse lever switch 41 shown in FIG. 2.

As shown in FIG. 1, the main body housing 2 houses a planetary gear reduction mechanism 12 in front of the motor 4. The planetary gear reduction mechanism 12 is configured to decelerate the rotation of a rotation shaft (hereinafter, motor shaft) 5 of the motor 4 and to output the decelerated rotation. The planetary gear reduction mechanism 12 is configured by axially arranging carriers 13*a* and 13*b* that respectively support planetary gears 14*a* and 14*b*. An output disk 15 is fitted to the carrier 13*b* in an integrally rotatable manner. The output disk 15 journally supports, in a coaxial manner, a rear end of a spindle 16 provided within the leading-end housing 6. A leading end of the spindle 16 is coaxially coupled to a rear end of the output shaft 8.

A coupling disk 19 is externally provided at a rear part of the spindle 16 so as to be rotatable integrally with the spindle 16 and so as to be axially movable by means of a steel ball 22. The coupling disk 19 has a diameter substantially the same as that of the output disk 15. Coupling grooves 20 and 21 are axially provided in a recessed manner on an outer peripheral surface of the spindle 16 and an inner peripheral surface of the coupling disk 19, respectively. The steel ball 22 is positioned between the coupling grooves 20 and 21.

Provided at a front part of the spindle 16 is a threaded portion 23, and a feed screw disk 24 having a disk-like shape is threadedly mounted on the threaded portion 23. Further provided at the front part of the spindle 16, in the rear of the feed screw disk 24, is a spring receiving disk 25 freely fitted so as to be axially movable. The spring receiving disk 25 is of a shape of a disk having a diameter substantially the same as that of the feed screw disk 24. A coil spring 26 is provided between the spring receiving disk 25 and the coupling disk 19 positioned in the rear thereof. By being biased by the coil spring 26, the spring receiving disk 25 is pressed against the feed screw disk 24, and the coupling disk 19 is pressed against the output disk 15.

Provided at a front side of the spring receiving disk 25 is an insertion groove 28 into which a tip of a screwdriver (hand tool) can be inserted through a window 27 drilled in an upper part of the leading-end housing 6. The feed screw disk 24 includes, on a rear-side outer periphery thereof, teeth 29 provided radially at regular intervals. The teeth 29 can engage with the screwdriver inserted into the insertion groove 28. When the screwdriver is rotated with the tip thereof inserted into the insertion groove 28, the feed screw disk 24 is rotated by receiving a rotating force applied from the screwdriver via the teeth 29 to thereby move in an axial direction by a feed screw mechanism. An amount of compression, that is, a pressing force of the coil spring 26 is adjusted by such movement.

A plurality of steel balls 32 are provided between the coupling disk 19 and the output disk 15 in a circumferential direction at specified intervals. The plurality of steel balls 32 are each positioned between concave portions 30 and 31 provided respectively on opposed surfaces of the coupling disk 19 and the output disk 15. The steel balls 32 integrate the coupling disk 19 with the output disk 15 with the presence of the pressing force of the coil spring 26, so that the coupling disk 19 and the output disk 15 are interlocked with each other in terms of a rotation direction.

The rotation of the motor shaft 5 is transmitted to the output disk 15 via the planetary gear reduction mechanism 12 to thereby rotate the output disk 15. The rotation of the output disk 15 is transmitted to the coupling disk 19 via the steel balls 32 to thereby rotate the spindle 16 and the output shaft 8, which are rotated integrally with the coupling disk 19. Externally provided at the front end of the output shaft 8 is a chuck sleeve 34. The chuck sleeve 34 is configured as an attachment portion to which a tip tool, such as a driver bit, is attached.

In the thus-configured electric power tool 1, when the trigger 10 is operated in a state where the rotation direction of the motor 4 is set to the forward rotation direction by the forward/reverse lever 11, the trigger switch 9 is turned ON to cause the forward rotation of the motor 4 (i.e., to rotate the motor 4 in the forward rotation direction).

Then, the rotation of the motor shaft 5 is transmitted to the spindle 16 via the planetary gear reduction mechanism 12, to thereby rotate the output shaft 8 in a direction for tightening the screw (i.e., in the clockwise direction). Such rotation enables screw-tightening by the tip tool attached to the chuck sleeve 34. At the time of such screw-tightening, reaction force in a direction opposite to the tightening direction is applied to the main body housing 2 and the leading-end housing 6. The operator grabbing the handle 3 supports the handle 3 so as to resist the reaction force.

As the screw-tightening progresses, the load applied to the output shaft 8 is increased. When this load exceeds the pressing force of the coil spring 26 applied to the coupling disk 19 engaged with the output disk 15, the coupling disk 19 moves forward against the biasing force of the coil spring 26 to thereby disengage from the steel balls 32, resulting in interruption of transmission of the rotation from the output disk 15. As a result, the rotation of the spindle 16 and the output shaft 8 is stopped. That is, the output disk 15, the coupling disk 19, the coil spring 26, and the steel balls 32 form a torque limiting mechanism, and the transmission of the rotary movement from the motor 4 to the output shaft 8 is interrupted by a specified torque of the output shaft 8.

Figure 2:
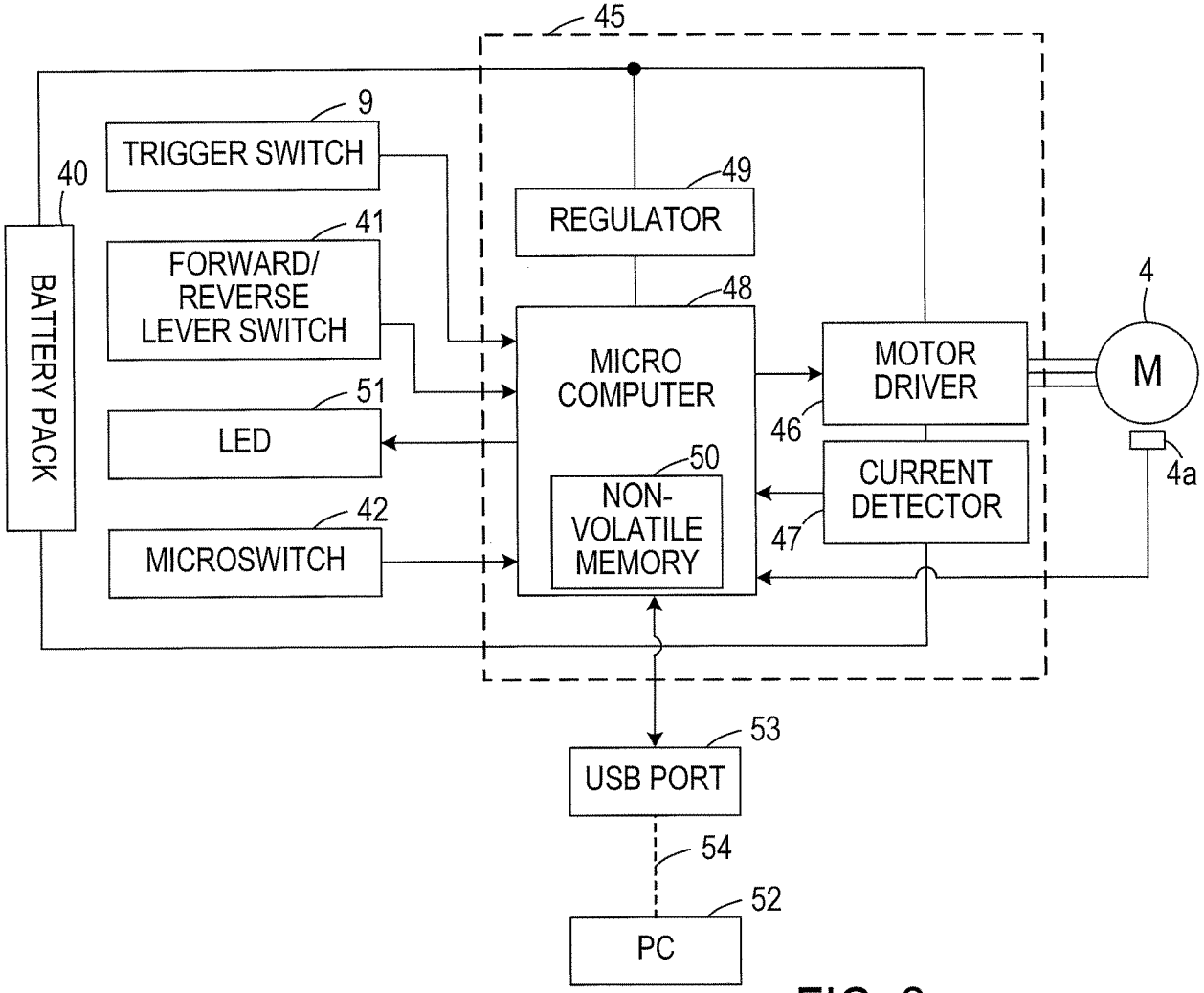
FIG. 2 is a block diagram showing an example circuit configuration of the electric power tool.

The disengagement of the coupling disk 19 from the steel balls 32 means release of the engagement between the concave portion 30 in the coupling disk 19 and each of the steel balls 32. When the coupling disk 19 disengages from the steel balls 32 to thereby interrupt the transmission of the rotation from the output disk 15, that is, when the torque limiting mechanism works, a microswitch 42 shown in FIG. 2 is turned ON. Upon turning-ON of the microswitch 42, the motor 4 automatically stops even when the operation of the trigger 10 is continued. The above-described torque limiting mechanism and an automatic stop function for the motor 4 following turning-ON of the microswitch 42 achieve a clutch function to stop the motor 4 when the tightening torque reaches a specified magnitude.

In a case of causing reverse rotation of the output shaft 8 for removal or the like of the screw, the user may set the rotation direction of the motor 4 to the reverse rotation direction using the forward/reverse lever 11 and then operate the trigger 10.

1-2. Circuit Configuration

Housed in the handle 3 of the electric power tool 1 is a control circuit 45 shown in FIG. 2. The control circuit 45 is configured to be operated by receiving power supply from the battery pack 40 and to perform processings related to control of the motor 4.

The control circuit 45 includes a motor driver 46, a current detector 47, a microcomputer 48, and a regulator 49. The motor driver 46 drives the motor 4 by energizing the motor 4. The current detector 47 detects current flowing through the motor 4. The microcomputer 48 functions as a controller to control operation of the control circuit 45.

The regulator 49 receives power supply from the battery pack 40, and supplies constant power-supply voltage to the microcomputer 48.

The microcomputer 48 includes a CPU, a ROM, and a RAM. Functions of the control circuit 45 are performed by execution, by the CPU in the microcomputer 48, of a computer program stored in a non-transitory tangible storage medium. In this example, the above-described ROM corresponds to the non-transitory tangible storage medium. The execution of the program causes a method corresponding to this program to be performed. The control circuit 45 may include a plurality of microcomputers. The functions of the control circuit 45 need not necessarily be performed by software. Some or all of the functions of the control circuit 45 may be performed by using hardware. Such hardware may be configured with a combination of a logic circuit, an analog circuit, and/or other circuits.

The microcomputer 48 controls the motor 4 via the motor driver 46 on the basis of a detection signal from a rotation sensor 4*a* provided to the motor 4 and/or a detection signal from the current detector 47 so that a rotation state of the motor 4 may become a target state.

The microcomputer 48 further includes a non-volatile memory 50. The non-volatile memory 50 is, for example, an electrically rewritable non-volatile memory, such as a flash memory or an EEPROM (Electrically Erasable Programmable Read Only Memory). The non-volatile memory 50 stores control conditions related to the motor 4.

Inputted to the microcomputer 48 is a signal, outputted from each of the trigger switch 9, the forward/reverse lever switch 41, and the microswitch 42, indicating an ON/OFF state of the corresponding switch. The microcomputer 48 determines the position of the forward/reverse lever 11 on the basis of the signal from the forward/reverse lever switch 41, and sets the rotation direction of the motor 4 on the basis of the determined position.

Further coupled to the microcomputer 48 are an LED (Light Emitting Diode) 51 for notifying the user of a state of the electric power tool 1, and a USB (Universal Serial Bus) port 53 for communication with an external personal computer (hereinafter, PC) 52. For example, as shown in FIG. 1, the LED 51 is arranged on a rear-side face of the main body housing 2, and the USB port 53 is arranged lower than the LED 51 on the main body housing 2. The microcomputer 48 can perform data communication with the PC 52 with the USB port 53 and the PC 52 being coupled to each other via a USB cable 54.

1-3. Processings

[1-3-1. Mode Switching Processing]

The execution of the program by the CPU in the microcomputer 48 enables the microcomputer 48 to perform a processing as described below.

Figure 3:
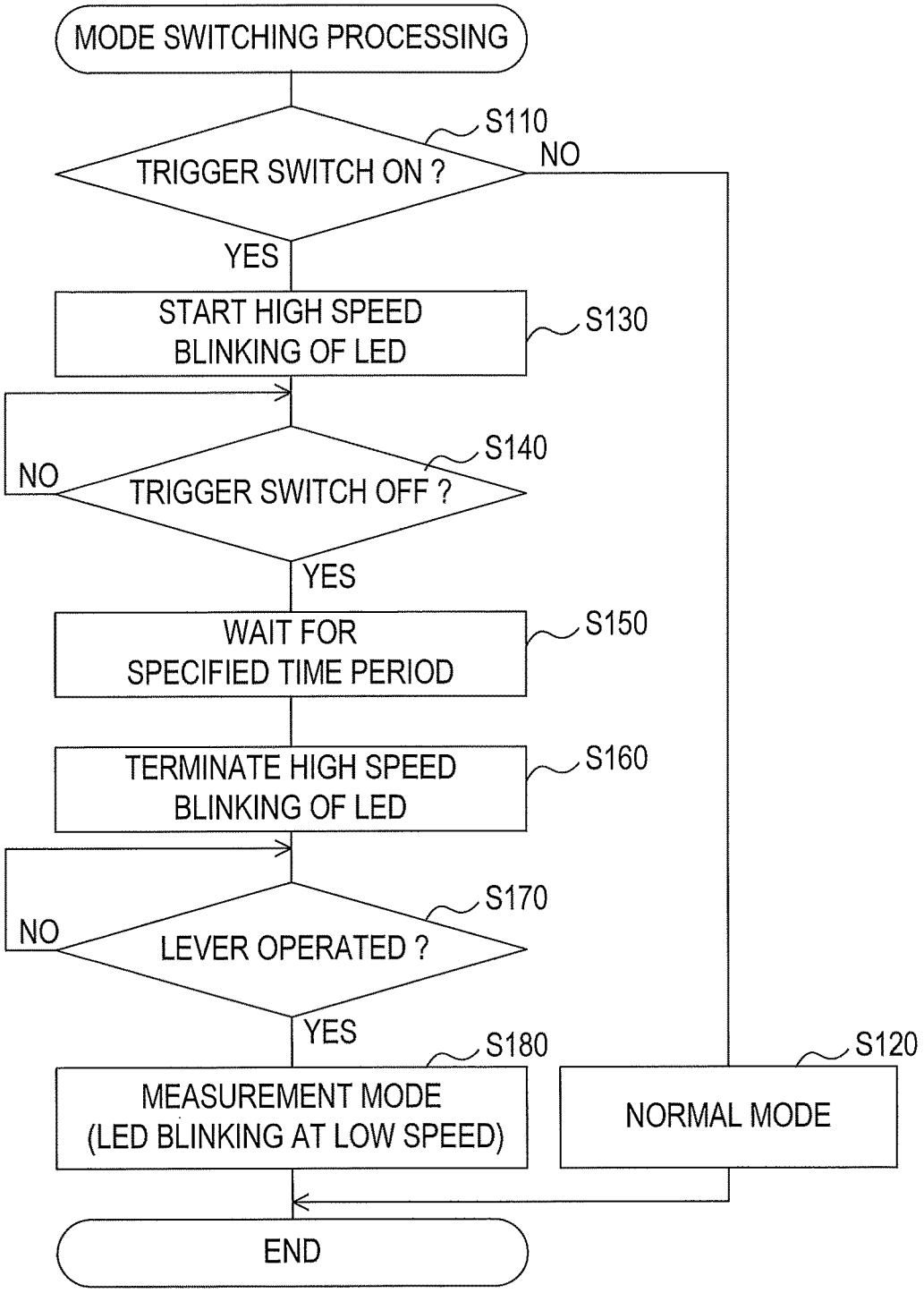
FIG. 3 is a flowchart showing a mode switching processing according to a first embodiment.

When the battery pack 40 is attached to the electric power tool 1, the microcomputer 48 starts up and performs a mode switching processing shown in FIG. 3.

Upon initiation of the mode switching processing, the microcomputer 48 determines in S110 whether the trigger switch 9 is ON. That is, in S110, it is determined whether the trigger 10 is being operated.

If it is determined in S110 that the trigger switch 9 is not ON, the processing proceeds to S120. In S120, the microcomputer 48 sets an operation mode of the microcomputer 48 related to control of the motor 4 to a normal mode, whereupon the mode switching processing is terminated. The normal mode is an operation mode employed for a screw-tightening operation.

If it is determined in S110 that the trigger switch 9 is ON, the processing proceeds to S130. In S130, the microcomputer 48 causes the LED 51 to start blinking at high speed. For example, the microcomputer 48 causes the LED 51 to blink at intervals of a specified time period T1 (for example, 0.5 seconds) and at a duty ratio of 50%.

In the next S140, the microcomputer 48 determines whether the trigger switch 9 has been turned OFF. When the operation of the trigger 10 is stopped, the trigger switch 9 is turned OFF. If it is determined that the trigger switch 9 has been turned OFF, the processing proceeds to S150. In S150, the microcomputer 48 waits for a specified period of time (for example, 3 seconds), and then terminates the high-speed blinking of the LED 51 in S160. That is, the LED 51 is to be kept off.

In the next S170, the microcomputer 48 determines whether the forward/reverse lever 11 has been operated on the basis of the signal from the forward/reverse lever switch 41. If it is determined that the forward/reverse lever 11 has been operated, the processing proceeds to S180. The operation of the forward/reverse lever 11 corresponds to the above-described sliding operation.

In S180, the microcomputer 48 sets the operation mode of the microcomputer 48 in controlling the motor 4 to a measurement mode. The measurement mode is an operation mode employed when measuring the tightening torque of the electric power tool 1 with a measuring instrument. Additionally, in S180, the microcomputer 48 causes the LED 51 to start blinking at low speed in order to notify the user that the measurement mode has been set. For example, the LED 51 is caused to blink at intervals of a time T2 (for example, 2 seconds), which is longer than the above-described specified time period T1, and at the duty ratio of 50%. Upon performance of the process of S180, the mode switching processing is terminated. The low-speed blinking of the LED 51 is continued during a period of time in which the microcomputer 48 is in the measurement mode.

Thus, the user can set the operation mode of the microcomputer 48, that is, a mode in which the microcomputer 48 controls the motor 4, to the measurement mode by performing a below-described specific operation.

The specific operation includes: a first operation to attach the battery pack 40 to the electric power tool 1 while keeping a pulling operation for the trigger 10; a second operation to stop the pulling operation for the trigger 10 upon acknowledgement of the high-speed blinking of the LED 51; and a third operation to operate the forward/reverse lever 11 upon termination of the high-speed blinking of the LED 51. A series of operations including the first, second, and third operations is not completed without the user's intention, that is, accidentally.

Information on the operation mode set in S120 or S180 is stored in the volatile RAM. The information on the set operation mode is cleared when the battery pack 40 is detached from the electric power tool 1.

Thus, in order to reset the operation mode of the microcomputer 48 from the measurement mode to the normal mode, the user may detach the battery pack 40 from the electric power tool 1 and then attach the battery pack 40 to the electric power tool 1 with the trigger 10 unoperated.

[1-3-2. Processing in Normal Mode]

Figure 4:
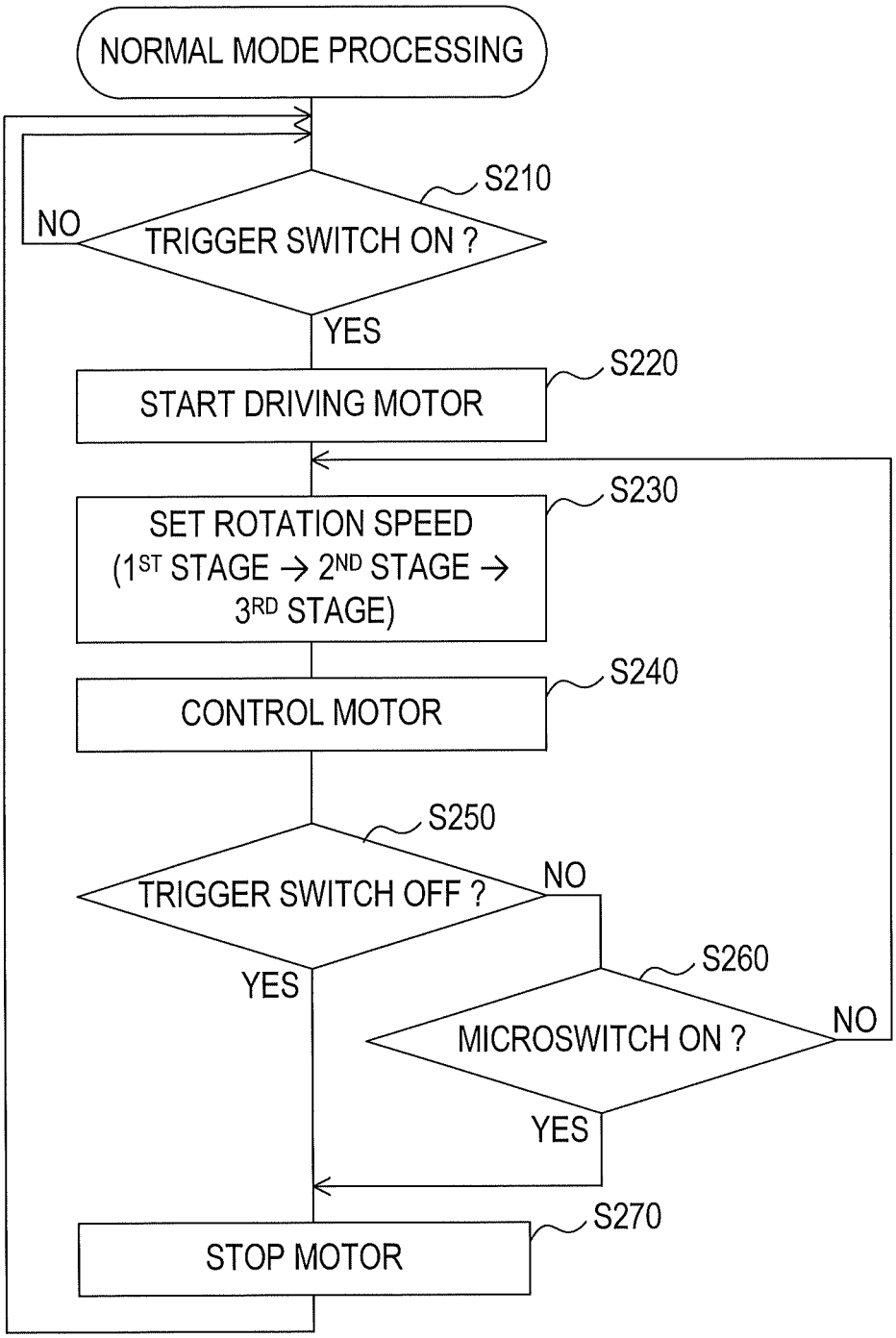
FIG. 4 is a flowchart showing a normal mode processing.

When the set operation mode is the normal mode, the microcomputer 48 performs a normal mode processing shown in FIG. 4 as a processing of controlling the motor 4. The normal mode processing shown in FIG. 4 is performed when the rotation direction of the motor 4 is set to the forward rotation direction.

Upon initiation of the normal mode processing, the microcomputer 48 determines in S210 whether the trigger switch 9 has been turned ON. Such determination is repeatedly performed until the trigger switch 9 is turned ON. If the microcomputer 48 determines that the trigger switch 9 has been turned ON, the microcomputer 48 causes driving of the motor 4 in S220. At this time, energization of the motor 4 is initiated via the motor driver 46, to thereby cause the motor 4 to rotate.

In the next S230, the microcomputer 48 sets a target rotation speed of the motor 4 in stages.

The normal mode includes a plurality of stages related to control of the motor 4 for performing screw-tightening. In the present embodiment, as shown in the graph of "normal mode" in FIG. 6 (i.e., the upper part of FIG. 6), the plurality of stages include three stages, that is, a first stage, a second stage, and a third stage. Times t1 to t3 each indicate a start timing of the first, second, and third stages, respectively.

The first stage, which is an initial stage immediately after the start of the screw-tightening, is a stage for controlling the rotation speed of the motor 4 to a first rotation speed N1. The second stage, which is a stage where the screw-tightening is underway, is a stage for controlling the rotation speed of the motor 4 to a second rotation speed N2. The third stage, which is a stage immediately before the end of the screw-tightening, is a stage for controlling the rotation speed of the motor 4 to a third rotation speed N3. In this example, the magnitude relationship between the rotation speeds N1 to N3 is "N1>N2>N3". However, the magnitude relationship is not limited to this and may be, for example, "N2>N1>N3".

The first stage is continued until an amount of motor rotation from the start of the first stage becomes a first rotation amount R1. The amount of motor rotation is an amount of rotation of the motor 4, and, in particular, the number of revolutions of the motor shaft 5. The second stage is continued until the amount of motor rotation from the start of the second stage becomes a second rotation amount R2. The third stage is continued until the above-described torque limiting mechanism works to turn ON the microswitch 42. In other words, the third stage is continued until the motor 4 is stopped by the above-described automatic stop function. In the case where the microswitch 42 is turned ON, the motor 4 is stopped by the above-described automatic stop function regardless of whether in the first stage or in the second stage.

Thus, in S230, the microcomputer 48 sets the target rotation speed to the first rotation speed N1, which is maintained until the amount of motor rotation from when driving of the motor 4 is started reaches the first rotation amount R1. When the amount of motor rotation reaches the first rotation amount R1, the target rotation speed is set to the second rotation speed N2, which is maintained until the amount of motor rotation from when the target rotation speed is set to the second rotation speed N2 reaches the second rotation amount R2. Then, when the amount of motor rotation from when the target rotation speed is set to the second rotation speed N2 reaches the second rotation amount R2, the target rotation speed is set to the third rotation speed N3, which is maintained thereafter.

The rotation speeds N1 to N3 each correspond to the control conditions of the motor 4 in the first, second, and third stages, respectively. The rotation amounts R1 and R2 each correspond to a parameter defining a period of time of the first and second stages, respectively. The rotation speeds N1 to N3 and the rotation amounts R1 and R2 are stored in the non-volatile memory 50. The rotation speeds N1 to N3 and the rotation amounts R1 and R2 stored in the non-volatile memory 50 can be rewritten (in other words, can be set) to any given values via the PC 52 coupled to the USB port 53.

In the next S240, the microcomputer 48 controls energization of the motor 4 so that the rotation speed of the motor 4 may become the target rotation speed set in S230.

In the next S250, the microcomputer 48 determines whether the trigger switch 9 is OFF. If the trigger switch 9 is not OFF (i.e., is still ON), the microcomputer 48 determines in S260 whether the microswitch 42 is ON. If it is determine that the microswitch 42 is not ON, the processing returns to S230.

If the microcomputer 48 determines in S250 that the trigger switch 9 is OFF, the processing proceeds to S270. In S270, the microcomputer 48 causes the motor 4 to stop, and the processing returns to S210.

Also in a case where the microcomputer 48 determines in S260 that the microswitch 42 is ON, the processing proceeds to S270 to cause the motor 4 to stop. Thus, even when the trigger switch 9 is ON, the microcomputer 48 causes the motor 4 to stop when the microswitch 42 is turned ON. The above-described automatic stop function (in other words, the clutch function) is performed when the microcomputer 48 determines in S260 that the microswitch 42 is ON and causes the motor 4 to stop in S270.

In the normal mode processing as described so far, as long as the microswitch 42 is OFF while the trigger switch 9 is kept ON, the microcomputer 48 repeats the processes of S230 and S240. Thus, as shown in the upper part of FIG. 6, when the trigger switch 9 is turned ON, the microcomputer 48 performs, as control of the motor 4, the control at the first stage, where the rotation speed is maintained to the first rotation speed N1, the control at the second stage, where the rotation speed is maintained to the second rotation speed N2, and the control at the third stage, where the rotation speed is maintained to the third rotation speed N3, in this order.

Figure 6:
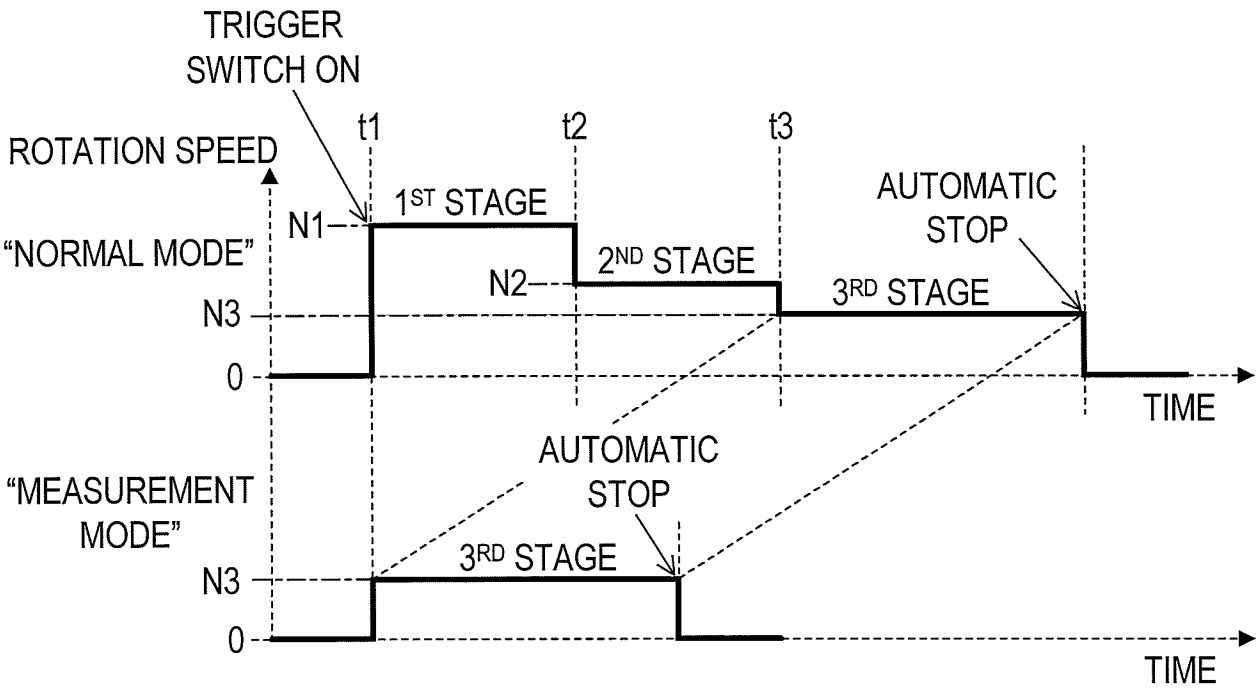
FIG. 6 is an explanatory diagram explaining relationships between: the normal mode and the measurement mode; and a plurality of stages.

"Automatic stop" indicated in FIG. 6 means automatic stop by the clutch function. In FIG. 6, the third stage is terminated by such automatic stop by the clutch function.

In the present embodiment, the tightening torque at the third stage is measured by the measuring instrument. The measuring instrument is configured to measure the tightening torque at the third stage. In the assembly plants for the industrial products, an electric power tool used for screw-tightening operation for the industrial products is required to have the tightening torque kept within a stipulated range. Thus, the tightening torque of the electric power tool is periodically measured by a measuring instrument. In the present embodiment, the third stage is a measurement target stage where the tightening torque of the electric power tool 1 is measured.

[1-3-3. Processing in Measurement Mode]

Figure 5:
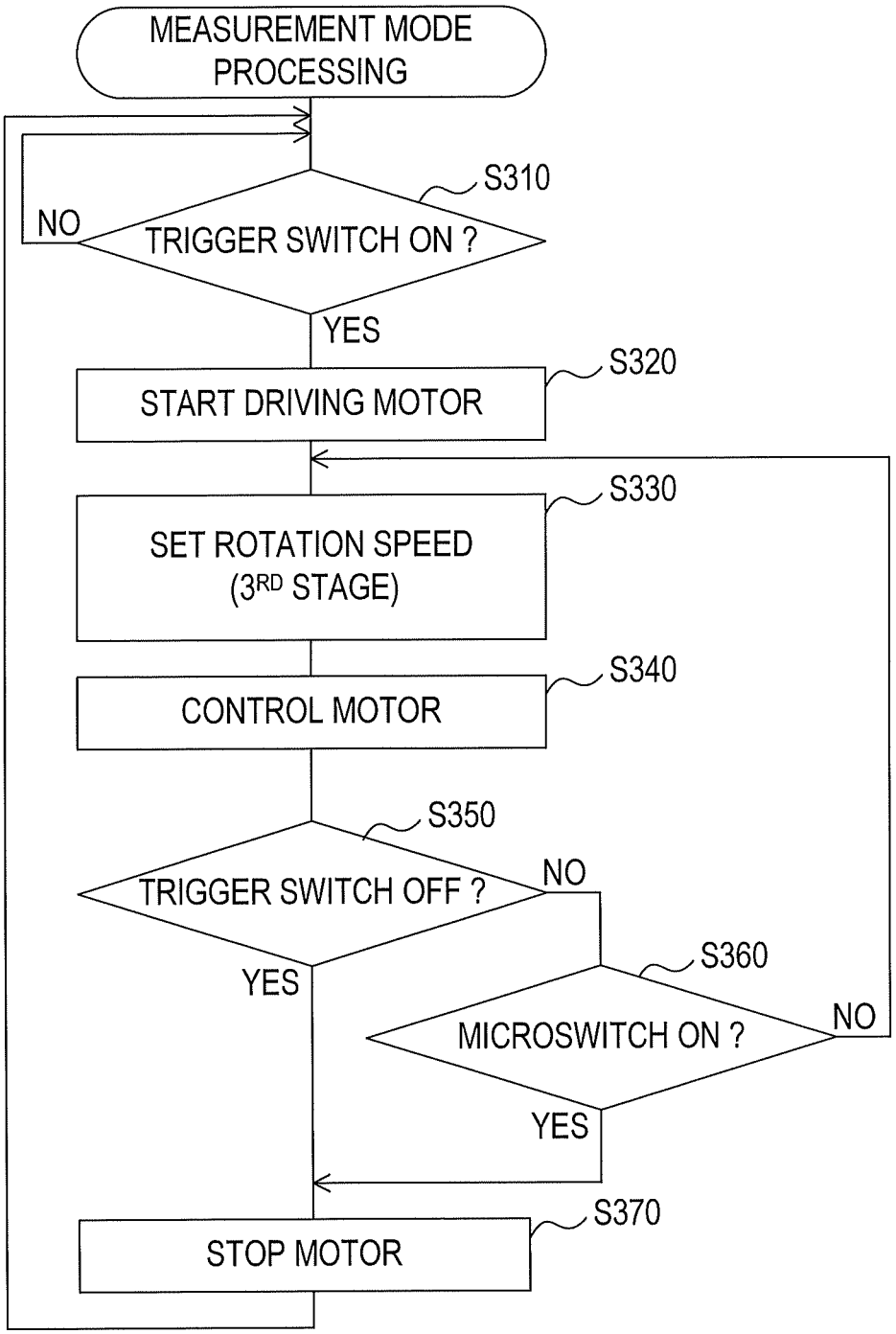
FIG. 5 is a flowchart showing a measurement mode processing.

When the operation mode is set to the measurement mode by the mode switching processing, the microcomputer 48 performs a measurement mode processing shown in FIG. 5.

The processes of S310, S320, and S340 to S370 in FIG. 5 are the same as the processes of S210, S220, and S240 to S270 in FIG. 4, although the step numbers assigned thereto are each smaller by 100. The process of S330 is different from the process of S230.

In S330, the microcomputer 48 sets the target rotation speed of the motor 4 to the third rotation speed N3 alone.

Thus, in the case of the measurement mode, as shown in the graph of "measurement mode" in FIG. 6 (i.e., the lower part of FIG. 6), when the trigger switch 9 is turned ON, the controls at the first and second stages are not performed and the control at the third stage alone is performed as the control of the motor 4.

1-4. Effects

According to the first embodiment, the following effects (1a), (1b), (1c), and (1d) are produced.

(1a) The microcomputer 48 includes the measurement mode as the operation mode, separately from the normal mode for performing the screw-tightening. In the measurement mode, the microcomputer 48 performs the control at the third stage alone among the controls at the first to third stages.

Thus, in the measurement mode, a period of time Ts from when the trigger 10 is operated until when the control at the third stage is started (hereinafter, a measurement target start time Ts) is shorter than that in the normal mode. In the present embodiment, the measurement target start time Ts in the measurement mode is zero.

Accordingly, by setting the operation mode of the microcomputer 48 to the measurement mode, the time required for the measurement of the tightening torque is shortened. Assuming that the tightening torque is measured in the normal mode, the measuring instrument has to wait for the lapse of the period of time from the time t1 to the time t3 shown in FIG. 6 and then to start the measurement. In the measurement mode, the measurement of the tightening torque by the measuring instrument can be started without waiting for the lapse of the period of time from the time t1 to the time t3 shown in FIG. 6.

In the above-described embodiment, the microcomputer 48 performs, in the measurement mode, no controls at any of the stages set prior to the third stage (i.e., the first and second stages) among the controls at the respective stages performed in the normal mode.

However, as a modified example, the microcomputer 48 may be configured to perform, in the measurement mode, the control at either of the stages set prior to the third stage among the controls at the respective stages performed in the normal mode.

Figure 7:
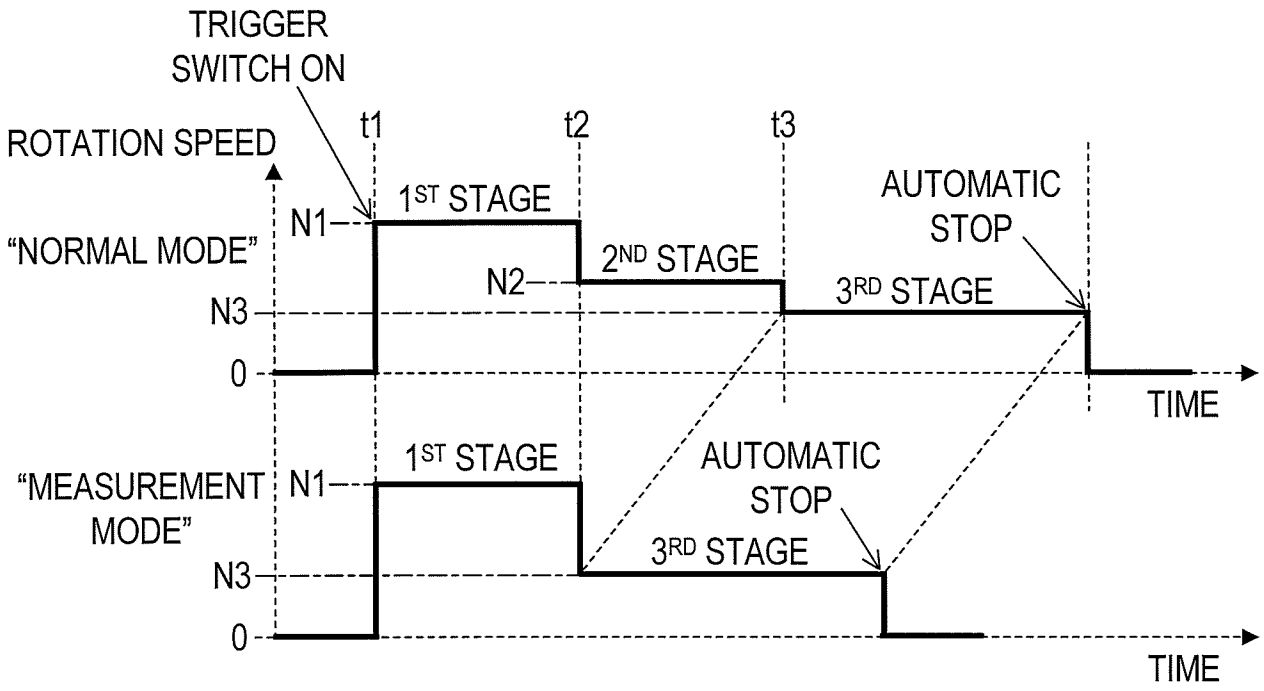
FIG. 7 is an explanatory diagram for a modified example.

FIG. 7 shows an example in which the control at the first stage is performed prior to the third stage of the measurement mode. In this example, the control at the second stage is not performed. In this case, in S330 in FIG. 5, the microcomputer 48 sets the target rotation speed to the first rotation speed N1, which is maintained until the amount of motor rotation from when driving of the motor 4 is started reaches the first rotation amount R1. When the amount of motor rotation from when driving of the motor 4 is started reaches the first rotation amount R1, the microcomputer 48 sets the target rotation speed to the third rotation speed N3. As a further modified example, in the measurement mode, the control at the second stage, instead of the first stage, may be performed prior to the third stage.

Also with these modified examples, in the measurement mode, the above-described measurement target start time Ts is shortened as compared with that in the normal mode. Accordingly, the time required for measurement of the tightening torque can be shortened.

As yet another modified example, the microcomputer 48 may be configured to perform the controls at the first and second stages prior to the third stage of the measurement mode but to perform the control at at least one of the first stage or the second stage for a period of time shorter than that in the normal mode. Any method may be adopted as a method for shortening the above-described measurement target start time Ts in the measurement mode as compared with that in the normal mode.

In a case where a measured value of the tightening torque of the electric power tool 1 is out of the stipulated range, the user can adjust the tightening torque of the electric power tool 1 by inserting the screwdriver (hand tool) into the insertion groove 28 through the window 27 and rotating the screwdriver to thereby adjust the amount of compression of the coil spring 26. Specifically, the tightening torque can be adjusted so that the torque limiting mechanism and the clutch function may work effectively.

(1b) In the mode switching processing, the microcomputer 48 switches the operation mode to the measurement mode upon determining that the above-described specific operation has been performed by the user. Thus, the user can set the operation mode of the microcomputer 48 to the measurement mode at any given timing.

(1c) The specific operation to set the operation mode to the measurement mode includes the first operation to "attach the battery pack 40 to the electric power tool 1 while keeping the trigger 10 operated". Since such an operation is usually not performed, it is possible to inhibit the user from erroneously setting the operation mode of the microcomputer 48 to the measurement mode.

(1d) The above-described specific operation also includes the second operation to "stop the operation of the trigger 10 after the battery pack 40 is attached". Thus, the effect of inhibiting the user's erroneous setting of the operation mode of the microcomputer 48 to the measurement mode can be enhanced.

Further, the above-described specific operation also includes the third operation to "operate the forward/reverse lever 11 after the operation of the trigger 10 is stopped". Thus, the effect of inhibiting the user's erroneous setting of the operation mode of the microcomputer 48 to the measurement mode can be further enhanced.

In the first embodiment, the microcomputer 48 corresponds to one example of a controller, and the third stage, which is the measurement target stage, corresponds to one example of a specific stage.

2. Second Embodiment

A basic configuration of an electric power tool of a second embodiment is the same as that of the first embodiment. Thus, the electric power tool of the second embodiment will be described below focusing on differences in configuration from that of the first embodiment. The reference numeral used for the electric power tool of the second embodiment is "1", which is the same as that of the first embodiment. Also as for the reference numerals other than "1", the reference numerals that are the same as those in the first embodiment indicate that the elements bearing such reference numerals are the same as those in the first embodiment, and reference is to be made to the precedent descriptions.

2-1. Differences from First Embodiment

Figure 8:
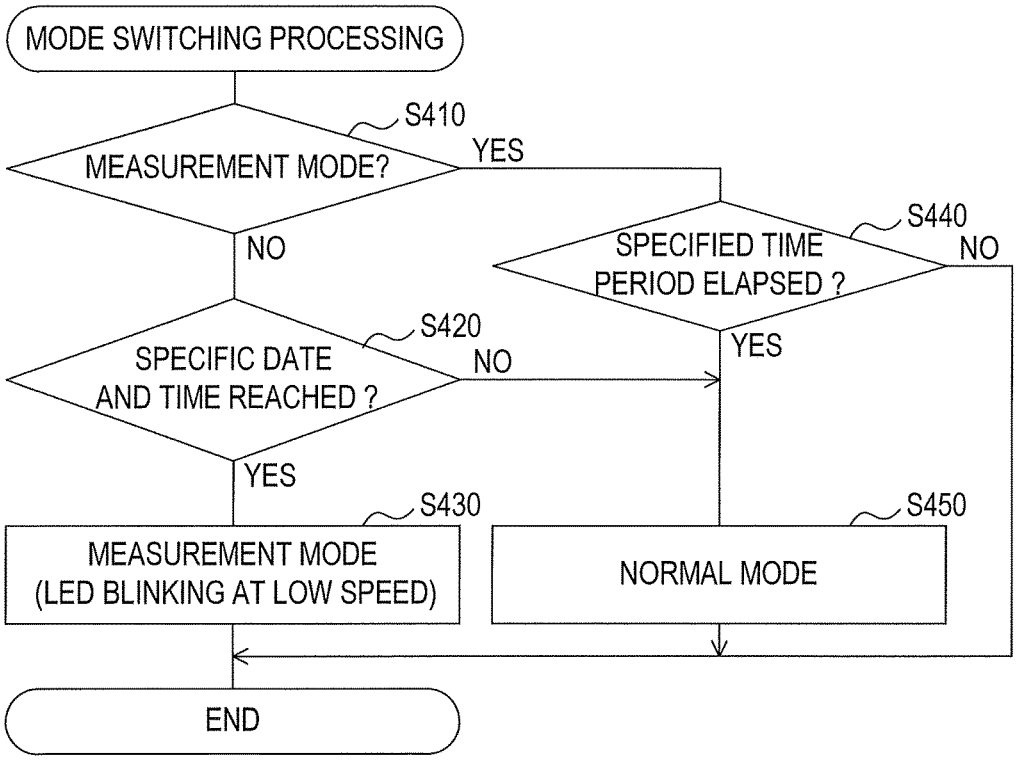
FIG. 8 is a flowchart showing a mode switching processing according to a second embodiment.

In the electric power tool 1 of the second embodiment, the microcomputer 48 performs a mode switching processing shown in FIG. 8, instead of the mode switching processing shown in FIG. 3. The mode switching processing shown in FIG. 8 is performed, for example, at specified intervals.

Upon starting the mode switching processing shown in FIG. 8, the microcomputer 48 determines in S410 whether the currently set operation mode is the measurement mode. If the microcomputer 48 determines that the set operation mode is not the measurement mode (i.e., if the set operation mode is the normal mode), the microcomputer 48 determines in S420 whether a specific date and time has been reached.

The specific date and time corresponds to a date and time when the operation mode of the microcomputer 48 is to be set to the measurement mode. The specific date and time is stored in, for example, the non-volatile memory 50 together with a specified time period to be referred to in S440, which will be described later. The specific date and time and the specified time period stored in the non-volatile memory 50 can be rewritten (i.e., can be set) to any given date and time and to any given time period, respectively, via the PC 52 coupled to the USB port 53. The specific date and time to be set can be defined by, for example, a combination of year, month, date, hour, and minute. The specific date and time may be defined by a combination of day of the week, hour, and minute. The microcomputer 48 may have a clock. The microcomputer 48 can be configured to determine whether the specific date and time has been reached on the basis of time information from the clock. The microcomputer 48 may be configured to obtain the time information from a device or facility external to the electric power tool 1 via wireless communication and to determine whether the specific date and time has been reached on the basis of the obtained time information.

If the microcomputer 48 determines that the specific date and time has been reached, the microcomputer 48 performs, in S430, a process that is the same as that of S180 shown in FIG. 3. Specifically, the microcomputer 48 sets the operation mode thereof to the measurement mode and causes the LED 51 to start blinking at low speed for the purpose of notification to the user. Then, the mode switching processing is terminated.

If the microcomputer 48 determines in S410 that the currently set operation mode is the measurement mode, the processing proceeds to S440, where the microcomputer 48 determines whether the above-described specified time period has elapsed after the operation mode is switched to the measurement mode. If the microcomputer 48 determines in S440 that the specified time period has not elapsed, the mode switching processing is terminated with no process performed. If the microcomputer 48 determines that the specified time period has elapsed, the processing proceeds to S450, where the microcomputer 48 performs a process that is the same as that of S120 shown in FIG. 3. In S450, the operation mode of the microcomputer 48 is set to the normal mode. That is, the operation mode of the microcomputer 48 is switched from the measurement mode to the normal mode. Then, the microcomputer 48 terminates the mode switching processing.

Also in a case where the microcomputer 48 determines in S420 that the specific date and time has not been reached, the microcomputer 48 performs the process of S450. In this case, the microcomputer 48 may terminate the mode switching processing without performing the process of S450. In any case, the normal mode is maintained.

The thus-configured electric power tool 1 of the second embodiment makes it possible to automatically bring the microcomputer 48 into the measurement mode when the specific date and time has been reached and to maintain the measurement mode for the specified time period.

2-2. Effects

According to the second embodiment, the following effects (2a) and (2b) are produced.

(2a) The operation mode of the microcomputer 48 can be automatically set to the measurement mode.

(2b) In the case where the specific date and time for determination in S420 is set to, for example, a specific time on a specific day of the week, every time such a specific time on such a specific day of the week is reached, the operation mode of the microcomputer 48 can be set to the measurement mode, which is maintained for the specified time period. Thus, the operation mode of the microcomputer 48 can be automatically set to the measurement mode to be maintained, for example, only during a period of time from 8:00 to 9:00 on Mondays.

The switching of the operation mode from the measurement mode to the normal mode may be performed regardless of the lapse of the specified time period. The switching to the normal mode may be performed when, for example, the user detaches the battery pack 40 from the electric power tool 1 and attaches the battery pack 40 again.

Similarly to the first embodiment, the mode switching processing shown in FIG. 3 may also be performed in the second embodiment.

3. Other Embodiments

Although the embodiments of the present disclosure have been described so far, the present disclosure is not limited to the above-described embodiments and may take various forms. The above-described numerical values are one example, and other numerical values may be adopted.

For example, in each of the normal mode and the measurement mode, the measurement target stage for the tightening torque need not be the last stage. One or more other stages may be present after the measurement target stage. In the normal mode, the number of the stages present before the measurement target stage is not limited to two but may be only one or may be three or more. Among the plurality of stages of the normal mode, a stage whose start is to be advanced in the measurement mode is not limited to the third stage but may be the second stage or may be the fourth or later stage. The plurality of stages may include a stage where the motor 4 is reversely rotated.

The number of the stages of each of the normal mode and the measurement mode may be optionally settable via the PC 52. The parameter defining the period of time of each stage is not limited to the amount of motor rotation but may be, for example, time length. The control conditions in each stage are not limited to the conditions related to the rotation speed but may be, for example, conditions related to the magnitude of drive current.

The external device to set the operating conditions for the electric power tool 1, such as the control conditions in each stage, the parameter defining the period of time, the number of stages, and so on, is not limited to the PC 52 but may be a dedicated terminal device, a smartphone, or the like. Communication between such an external device and the microcomputer 48 may be wireless communication.

The notification, to the user, of the microcomputer 48 being in the measurement mode is not limited to the notification via the LED 51 but may be, for example, notification via sound or notification via graphics display. A configuration may be adopted in which the switching of the operation mode of the microcomputer 48 is performed by a specific switch. In this case, the microcomputer 48 may be configured to set the operation mode of the microcomputer 48 to either the normal mode or the measurement mode on the basis of an ON/OFF state of a mode switchover switch. The use application of the second mode, which is different from that of the first mode (normal mode), is not limited to the use application for the measurement of the tightening torque. The second mode may be employed, for example, for operation check as to whether the motor is rotated at a specific rotation speed. The operation portion to start the motor 4 is not limited to the trigger 10. The operation portion may be, for example, a push button.

The clutch function may be performed without using the torque limiting mechanism. For example, the electric power tool 1 may include a torque sensor that detects a torque of the output shaft 8 (i.e., the tightening torque). The microcomputer 48 may be configured to stop the motor 4 when determining that a value detected by the torque sensor has become a set value. Alternatively, the microcomputer 48 may be configured, without the torque sensor, to calculate the tightening torque on the basis of the current flowing through the motor 4 or the rotation speed of the motor 4. The above-described set value may be optionally set via an external device such as the PC 52 as one of the operation conditions for the electric power tool 1.

The electric power tool is not limited to the rechargeable screwdriver. The electric power tool may be, for example, an impact driver, a drill, a circular saw, a grinder, a plane, a grass cutter, a chainsaw, a cut-off saw, a sprayer, a spreader, a blower, a dust collector, or the like. They are referred to as electric working machines in some cases. The electric power tool (electric working machine) is not limited to a rechargeable one and may be one that receives power supply via a cord.

A plurality of functions of one element in the above-described embodiments may be performed by a plurality of elements, and one function of one element may be performed by a plurality of elements. A plurality of functions performed by a plurality of elements may be performed by one element, and one function performed by a plurality of elements may be performed by one element. Part of the configuration of the above-described embodiments may be omitted. At least part of the configuration of the above-described embodiments may be added to or replaced with the configuration of other embodiments described above. Any modes within the scope of the technical ideas identified from the claim language are embodiments of the present disclosure. In addition to the above-described electric power tool, the present disclosure can be also implemented in various forms, such as a system including the electric power tool as an element, a program for causing a computer to serve as a controller of the electric power tool, a non-transitory tangible storage medium, such as a semiconductor memory, in which this program is stored, and a motor control method for the electric power tool.

What is claimed is:

1. An electric power tool comprising:

a motor; and a controller configured to control the motor, wherein:

the controller is configured to alternatively operate in at least a normal mode and a measurement mode;

the normal mode is an operation mode that (1) controls the motor so that the electric power tool performs the electric power tool's intended function and (2) includes normal mode stages having different control conditions related to the motor;

the different control conditions include that the normal mode stages each have a different predetermined target motor rotation speed with respect to other stages of the normal mode stages, such that the target motor rotation speeds have a stepped relationship;

the measurement mode (1) is an operation mode that is employed to measure an output of the electric power tool and (2) includes a first stage having control conditions same as those for a specific stage among the normal mode stages;

the first stage of the measurement mode starts more quickly than the specific stage of the normal mode when the electric power tool is activated; and the normal mode stages include stages other than the specific stage.

2. The electric power tool according to claim 1, wherein: the specific stage is a final stage of the normal mode.

3. The electric power tool according to claim 1,
wherein the normal mode is configured for a screw tightening operation, and
wherein the measurement mode is configured for measurement of a tightening torque.

4. The electric power tool according to claim 3,
wherein the motor is controlled to a rotation speed suitable for a final process of the screw-tightening operation in the specific stage and the first stage.

5. The electric power tool according to claim 1,
wherein the controller is configured to switch to the measurement mode at least partially based on a determination that a specific operation has been performed by a user.

6. The electric power tool according to claim 5,
wherein the specific operation includes a plurality of operations, and
wherein the controller is configured to switch to the measurement mode at least partially based on a determination that the plurality of operations have been performed in a specified order.

7. The electric power tool according to claim 1,
wherein the controller is configured to switch to the measurement mode at least partially based on a determination that a trigger switch is ON while a battery pack is being attached.

8. The electric power tool according to claim 1,
wherein the controller is configured to switch to the measurement mode at least partially based on: a determination that a trigger switch is ON while a battery pack is being attached; and a determination that the trigger switch has been switched off after the battery pack is attached.

9. The electric power tool according to claim 1,
wherein the controller is configured to switch to the measurement mode based on: a determination that a trigger switch is ON while a battery pack is being attached; a determination that the trigger switch has been switched OFF after the battery pack is attached; and a determination that a lever to switch a rotation direction of the motor has been operated after the trigger switch is switched OFF.

10. The electric power tool according to claim 1,
wherein the controller is configured to switch to the measurement mode based on a specified schedule.

11. The electric power tool according to claim 1,
wherein the controller is configured to perform the following steps:
determining that a trigger switch is ON while a battery pack is being attached;
starting blinking of a light emitting diode;
determining that the trigger switch is OFF;
terminating the blinking;
determining that a lever to switch a rotation direction of the motor has been operated; and
switching to the measurement mode.

12. The electric power tool according to claim 1,
wherein, in the final stage of the normal mode, the motor is controlled to a rotation speed lower than that in non-final normal mode stages.

13. The electric power tool according to claim 1,
wherein the controller is configured to perform the following steps:
determining that a trigger switch is ON while a battery pack is being attached;
starting first blinking of a light emitting diode at a first blinking rate;
determining that the trigger switch is OFF;
terminating the first blinking;
determining that a lever to switch a rotation direction of the motor has been operated;
switching to the measurement mode;
starting second blinking of the light emitting diode at a second blinking rate that is not equal to the first blinking rate.

14. The electric power tool according to claim 1,
wherein the controller is configured to switch to the normal mode after a specified time period has elapsed in the measurement mode.

15. The electric power tool according to claim 1 wherein:
the first stage ends at time $t_1$ and the specific stage starts at time $t_2$; and
time $t_1$ is before time $t_2$.

16. The electric power tool according to claim 1, wherein:
the controller proceeds through the normal mode stages without prompting by a user.

17. The electric power tool according to claim 1, wherein the measurement mode has a single set of control conditions that are the same as the control conditions for the specific stage such that the motor is controlled based on a single target rotation speed in measurement mode and the specific stage.

18. An electric power tool comprising:
a motor; and
a controller configured to control the motor, wherein:
the controller is configured to operate in at least a normal mode and a measurement mode;
the normal mode is an operation mode that (1) controls the motor so that the electric power tool performs the electric power tool's intended function and (2) includes normal mode stages having different control conditions related to the motor;
the different control conditions include that the normal mode stages each have a different predetermined target motor rotation speed with respect to other stages of the normal mode stages, such that the target motor rotation speeds have a stepped relationship;
the measurement mode (1) is an operation mode that is employed to measure an output of the electric power tool and (2) includes a common stage having control conditions same as those for a specific stage among the normal mode stages;
the common stage of the measurement mode starts more quickly than specific stage of the normal mode stage; and
the controller is configured to switch to the measurement mode upon determining that a specified date and time has been reached.

19. A machine comprising:
a motor; and
a controller that controls the motor,
wherein the controller is configured to perform a mode switching process that alternatively selects one of:
a measurement mode, and
a normal mode,
wherein the normal mode includes:
determining that a trigger switch is ON,
starting driving the motor,
setting a target rotation speed to:
a first stage speed for a predetermined first period of time, a second stage speed for a predetermined second period of time, and a last stage speed for a predetermined third period of time beginning at a normal target start time, wherein the first stage speed is different than the second stage speed and the last stage speed, and wherein the second stage speed is different than the last stage speed, such that a stepped relationship is formed by the first stage speed, the second stage speed and the last stage speed, determining that at least one of the following conditions is satisfied:

a trigger switch is OFF, and a microswitch is ON indicating that a torque limiting mechanism has been initiated, and stopping the motor, wherein the measurement mode includes:

determining that the trigger switch is ON, starting driving the motor, setting the target rotation speed to:

the last stage speed for a last period of time beginning at a measurement target start time, wherein the measurement target start time is a start time of driving the motor, determining that at least one of the following conditions is satisfied:

the trigger switch is OFF, and the microswitch is ON indicating that the torque limiting mechanism has been initiated, and stopping the motor.

* * * * *